US010071466B2

(12) United States Patent
Wilson et al.

(10) Patent No.: US 10,071,466 B2
(45) Date of Patent: Sep. 11, 2018

(54) TOOL SYSTEM FOR HAMMER UNION

(71) Applicant: Concentric Pipe and Tool Rentals, LLC, Harvey, LA (US)

(72) Inventors: David Wilson, Lafayette, LA (US); Chris Murray, Aberdeen (GB)

(73) Assignee: Warrior Energy Services Corporation, Houston, TX (US)

( * ) Notice: Subject to any disclaimer, the term of this patent is extended or adjusted under 35 U.S.C. 154(b) by 217 days.

(21) Appl. No.: 15/227,570

(22) Filed: Aug. 3, 2016

(65) Prior Publication Data

US 2016/0339563 A1 Nov. 24, 2016

Related U.S. Application Data

(63) Continuation-in-part of application No. 14/289,144, filed on May 28, 2014, now Pat. No. 9,415,487, and a continuation of application No. PCT/US2014/051601, filed on Aug. 19, 2014.

(60) Provisional application No. 61/868,400, filed on Aug. 21, 2013, provisional application No. 61/926,053, filed on Jan. 10, 2014.

(51) Int. Cl.

| | |
|---|---|
| ***B25B 13/50*** | (2006.01) |
| ***B25B 13/46*** | (2006.01) |
| ***B25B 13/02*** | (2006.01) |
| ***B25B 13/08*** | (2006.01) |
| ***B25B 13/04*** | (2006.01) |
| ***B25B 13/28*** | (2006.01) |
| ***B25B 21/00*** | (2006.01) |

(52) U.S. Cl.

CPC ..... *B25B 13/5091* (2013.01); *B25B 13/02* (2013.01); *B25B 13/04* (2013.01); *B25B 13/08* (2013.01); *B25B 13/28* (2013.01); *B25B 21/002* (2013.01)

(58) Field of Classification Search

CPC ..... B25B 13/5091; B25B 13/02; B25B 13/04; B25B 13/08; B25B 13/28; B25B 13/48; B25B 13/50; B25B 21/002

See application file for complete search history.

(56) References Cited

U.S. PATENT DOCUMENTS

| | | | |
|---|---|---|---|
| 1,387,867 | A | 8/1921 | Reed |
| 1,763,353 | A | 6/1930 | Heller |
| 1,945,406 | A | 1/1934 | Adams |
| 2,360,163 | A | 10/1944 | Sadler |
| 2,712,766 | A | 7/1955 | Buttke |
| D175,493 | S | 9/1955 | Brame |
| 2,758,493 | A | 8/1956 | Goldwater |
| 2,830,480 | A | 4/1958 | Brame |

(Continued)

OTHER PUBLICATIONS

PCT Application No. US2014/051601: International Search Report and Written Opinion of the International Searching Authority for Applicant Concentric Pipe and Tool Rentals, LLC dated Jan. 13, 2015.

*Primary Examiner* — David B Thomas

(74) *Attorney, Agent, or Firm* — Jones Walker LLP

(57) ABSTRACT

A tool, a tool system, and method for applying torque to a hammer union. The tool includes a handle attached to a tool head, and the tool head further includes at least two indentations, the indentations having a curved rearward wall and forming a mouth with a first width and a mid-section with a second width, wherein the mid-section width is greater than the mouth width.

8 Claims, 15 Drawing Sheets

(56) References Cited

U.S. PATENT DOCUMENTS

| | | | | |
|---|---|---|---|---|
| 3,003,379 | A | 10/1961 | Pribitzer | |
| 3,186,263 | A | 6/1965 | Grote | |
| 3,847,042 | A | 11/1974 | Wilson | |
| 4,095,494 | A | 6/1978 | Castoe | |
| 4,222,293 | A | 9/1980 | Schreyer | |
| 4,440,047 | A | 4/1984 | Robbins | |
| 4,597,123 | A | 7/1986 | Cobe | |
| 4,653,142 | A | 3/1987 | Upton | |
| 4,848,195 | A | 7/1989 | Hockenbery | |
| 4,930,816 | A | 6/1990 | Bling-Yih | |
| 5,524,511 | A | 6/1996 | Taka's | |
| 5,575,602 | A | 11/1996 | Savage | |
| 6,044,732 | A | 4/2000 | Astle | |
| 6,279,427 | B1 | 8/2001 | Francis | |
| 6,298,754 | B1 | 10/2001 | Brown | |
| 6,314,840 | B2 | 11/2001 | Bozonnet | |
| 6,745,649 | B1 | 6/2004 | Liao | |
| 7,059,424 | B2 | 6/2006 | Neal et al. | |
| 8,353,229 | B1 | 1/2013 | Muhareb | |
| 8,505,879 | B2 * | 8/2013 | Ruan | B25B 13/48 254/232 |
| D694,078 | S | 11/2013 | Dumaine et al. | |
| 8,573,096 | B1 | 11/2013 | De Los Santos | |
| 9,109,727 | B1 | 8/2015 | Madson | |
| 9,186,780 | B2 | 11/2015 | Dumaine et al. | |
| 9,266,225 | B2 * | 2/2016 | Schunke | B25B 13/04 |
| 9,415,487 | B2 * | 8/2016 | Wilson | B25B 13/5091 |
| 2005/0000329 | A1 | 1/2005 | Pregeant | |
| 2012/0048069 | A1 * | 3/2012 | Powell, Jr. | B25B 13/04 81/124.2 |
| 2012/0125162 | A1 | 5/2012 | Nguyen | |

* cited by examiner

TOOL SYSTEM FOR HAMMER UNION

CROSS-REFERENCE TO RELATED APPLICATIONS

This application is a continuation-in-part of U.S. Non-provisional application Ser. No. 14/289,144, filed on May 28, 2014, and is a continuation of Serial No. PCT/US14/51601, filed on Aug. 19, 2014, both of which claim the benefit under 35 U.S.C. § 119(e) of U.S. provisional application Ser. Nos. 61/868,400 filed Aug. 21, 2013 and 61/926,053 filed on Jan. 10, 2014. This application incorporates by reference all above applications in their entirety.

BACKGROUND OF INVENTION

The present invention relates to tools for applying torque to various types of connections or fixtures, including hammer union type connections.

Throughout many industries, particularly the oil and gas industry, there are mechanical joints or unions for connecting pipe sections which are generally referred to as "hammer unions." Hammer unions are initially positioned by hand and then, in order to force the final connection so there is no leak in the connection, these unions have what may be described as "upsets" or "dogs" around their surface so that workers may hammer them tightly closed to avoid leakage of high pressure fluids (e.g., up to 15,000 psi) running through the union.

As would be expected over time, since such unions are hammered opened and closed by manually striking the dogs with large hammers, these dogs around the outer rim of the union become warped and bent in the process. More particularly, because the hammer unions are being pounded closed or opened, the threads which engage the pipe between the union and the pipe may become warped or damaged in certain spots, which could compromise the seal the union is intended to form. Due to the high pressure environment, such leakage is very undesirable and may compromise safety. It is known that users may swing a heavy hammer multiple times in order to hit the dogs in tightening and/or loosening the hammer unions. For example, a worker may swing a hammer hundreds of times a day which may cause a serious impact to the unions, not to mention impact or injuries to the worker performing the operation. A safer, more consistent, and less damaging method of tightening and loosening hammer unions would be a significant improvement in the art.

SUMMARY

One embodiment of the invention is a tool for applying torque to a hammer union having three upsets. The tool comprises a handle attached to a tool head, the tool head including at least two indentations, the indentations having a curved rearward wall and forming a mouth with a first width and a mid-section with a second width, wherein the mid-section width is greater than the mouth width.

Another embodiment is a tool for applying torque to a hammer union having three upsets. The tool comprises a handle attached to a tool head. The tool head includes at least two indentations, the indentations having a curved rearward wall forming a mouth with a first width and a mid-section with a second width, wherein the mid-section width is greater than the mouth width. One face of the tool head further comprises stop surfaces extending at least partially over at least one of the indentations.

A further embodiment is a tool for applying torque to a hammer union. The tool comprises a handle attached to a tool head and the tool head includes at least three teeth, at least one of the teeth has a mid-portion and an enlarged end portion wider than the mid-portion. Indentations are formed between the teeth, the indentations having a mouth width and a mid-section width, wherein the mid-section width is greater than the mouth width.

Many additional embodiments will be apparent in the following description and claims and their omission from the above summary of selected embodiments should not be considered a limitation on the scope of the present invention.

DETAILED DESCRIPTION OF SELECTED EMBODIMENTS

Figure 1:
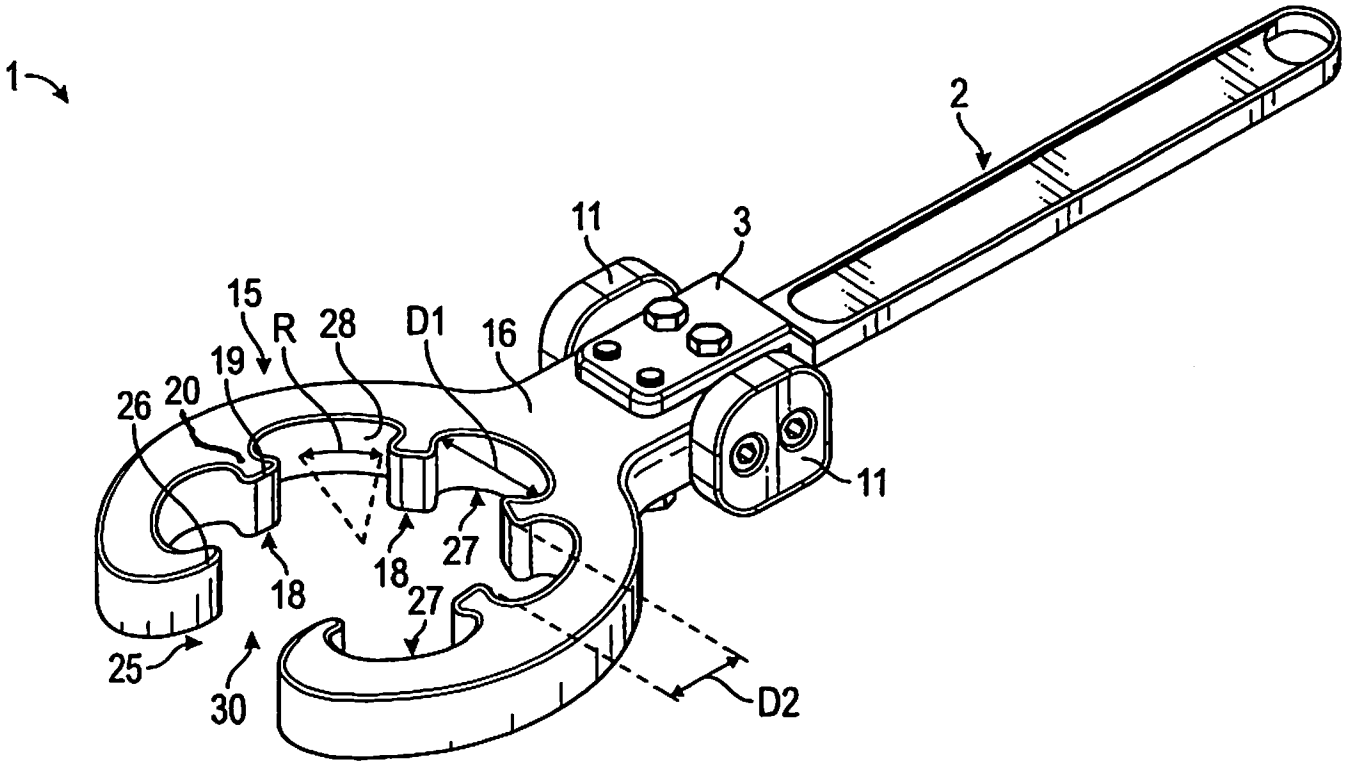
FIG. 1 is a perspective view of one embodiment of the hammer union tool of the present invention.
Figure 3:
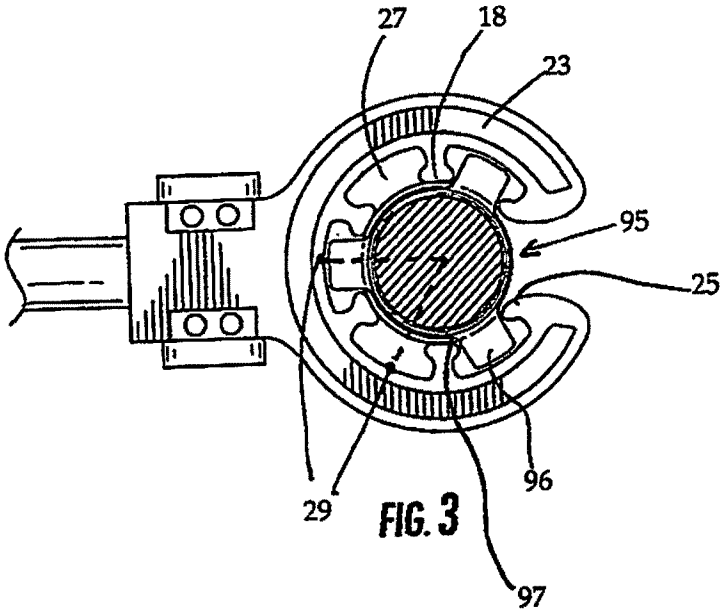
FIG. 3 is a top planar view of the FIG. 2 embodiment.

FIG. 1 illustrates one embodiment of the hammer union tool of the present invention. In the FIG. 1 embodiment, the hammer union tool 1 generally comprises a handle 2 with a fork section 3, which in turn connects to base section 16 of tool head 15. This embodiment of tool head 15 further includes an open throat section 30 and a series of indentations 27 formed in the tool head's interior circumference. These indentations 27 have a curved rearward wall 28 which includes a radius of curvature of "R." In certain embodiments, the radius of curvature may be between about 0.5 inches and about 2.5 inches, but may be outside this range in other embodiments. Each side of the indentations terminates in a tooth member 18 or 25. Several of the tooth members in FIG. 1 are "dual-sided" tooth members 18 in that they separate two adjacent indentations 27 and each side of a tooth member 18 is designed to be the contact surface for a hammer union (as illustrated in FIG. 3). The tooth members 25 on each side of throat section 30 are "single sided" tooth members since they taper to a single point and possess only one surface for contacting a hammer union. Further features of indentations 27 seen in FIG. 1 include a width D1 at the mid-section of the indentations and a width D2 at the mouth of the indentations (i.e., the closest distance between two adjacent tooth members 18). In these embodiments, the mid-section width is greater than the mouth width. In some embodiments, the multiple curved indentation tool head will be described as having a "clover-leaf" pattern. The handle and tool head may be constructed of any conventional or future developed material having sufficient strength characteristics. Certain preferred embodiments may be constructed of lighter weight materials such as aircraft aluminum, titanium, or carbon fiber materials.

Figure 4A:
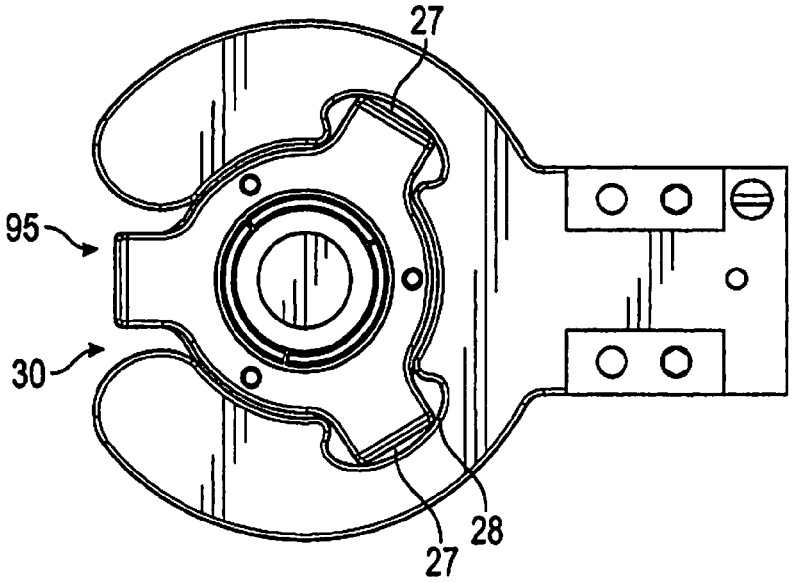
FIG. 4A is a top planar view of a third hammer union tool embodiment.
Figure 5A:
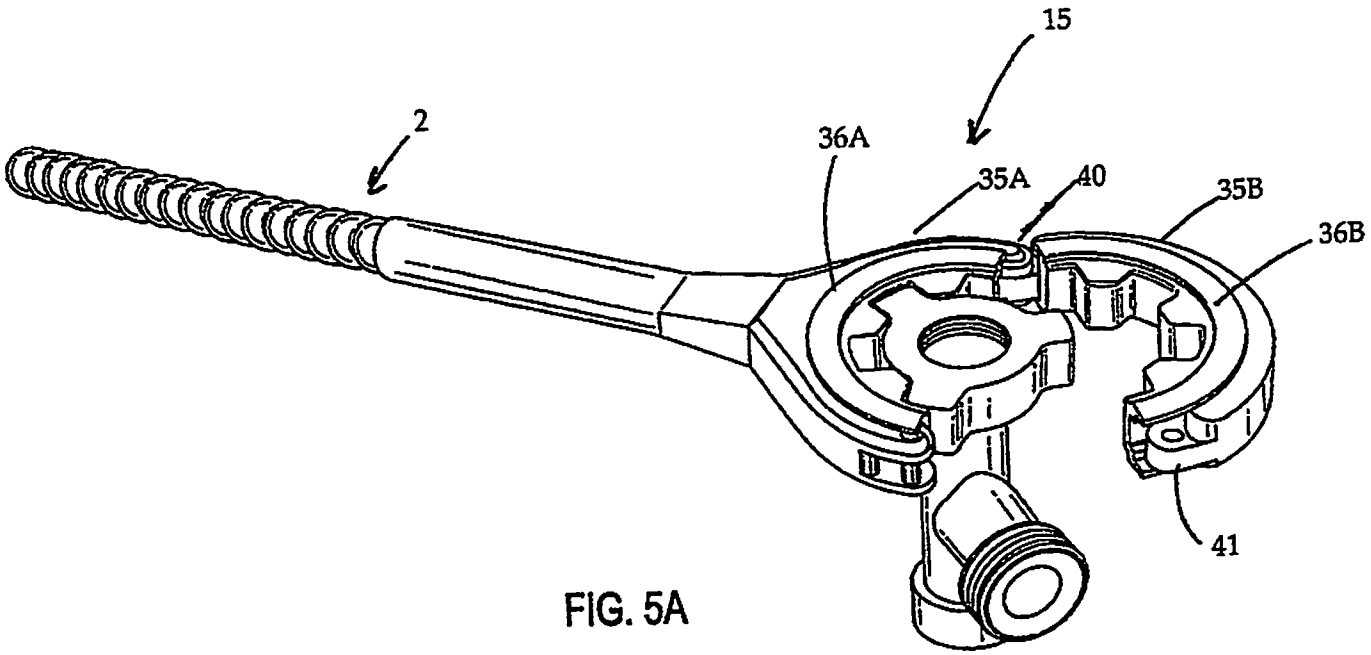
FIGS. 5A to 5C are perspective views of a fifth hammer union tool embodiment.
Figure 5B:
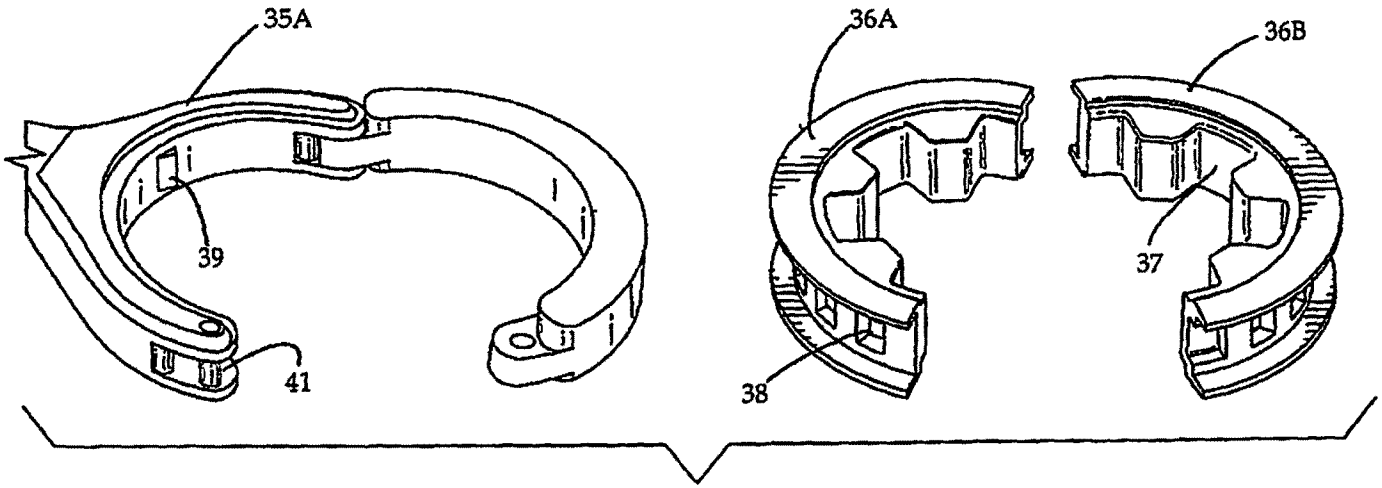
Figure 5C:
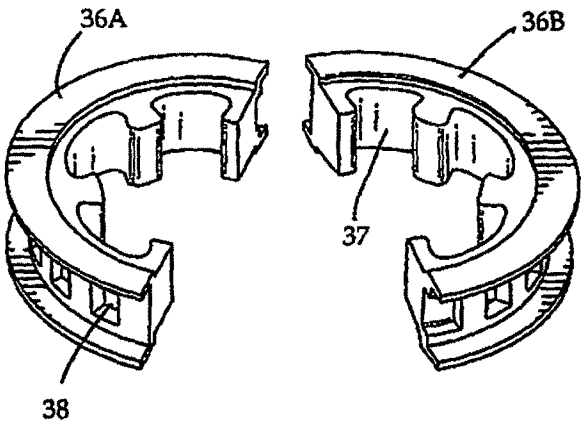
Figures 6A, 6B:
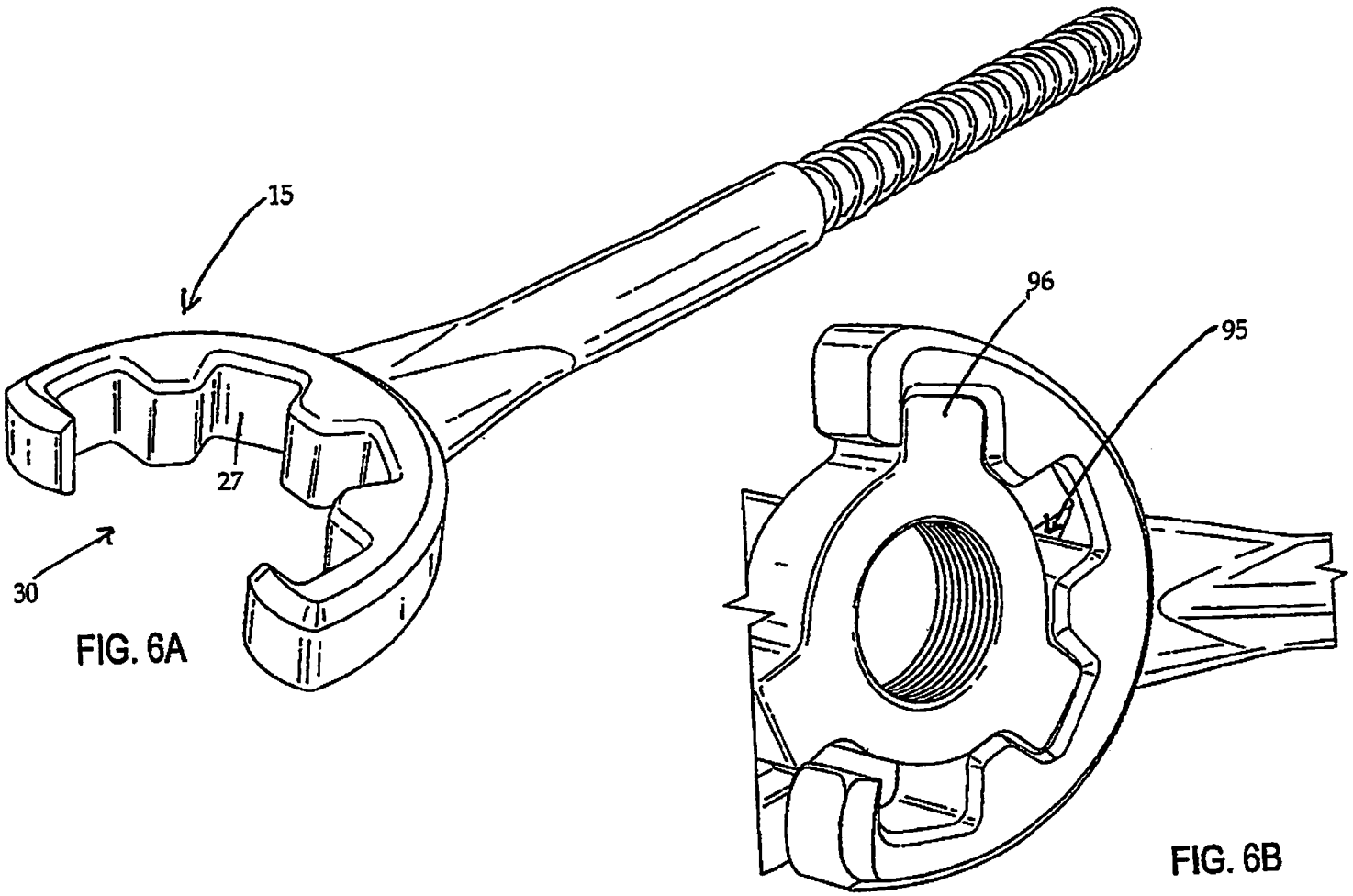
FIGS. 6A to 6C are perspective views of a sixth hammer union tool embodiment.
Figure 6C:
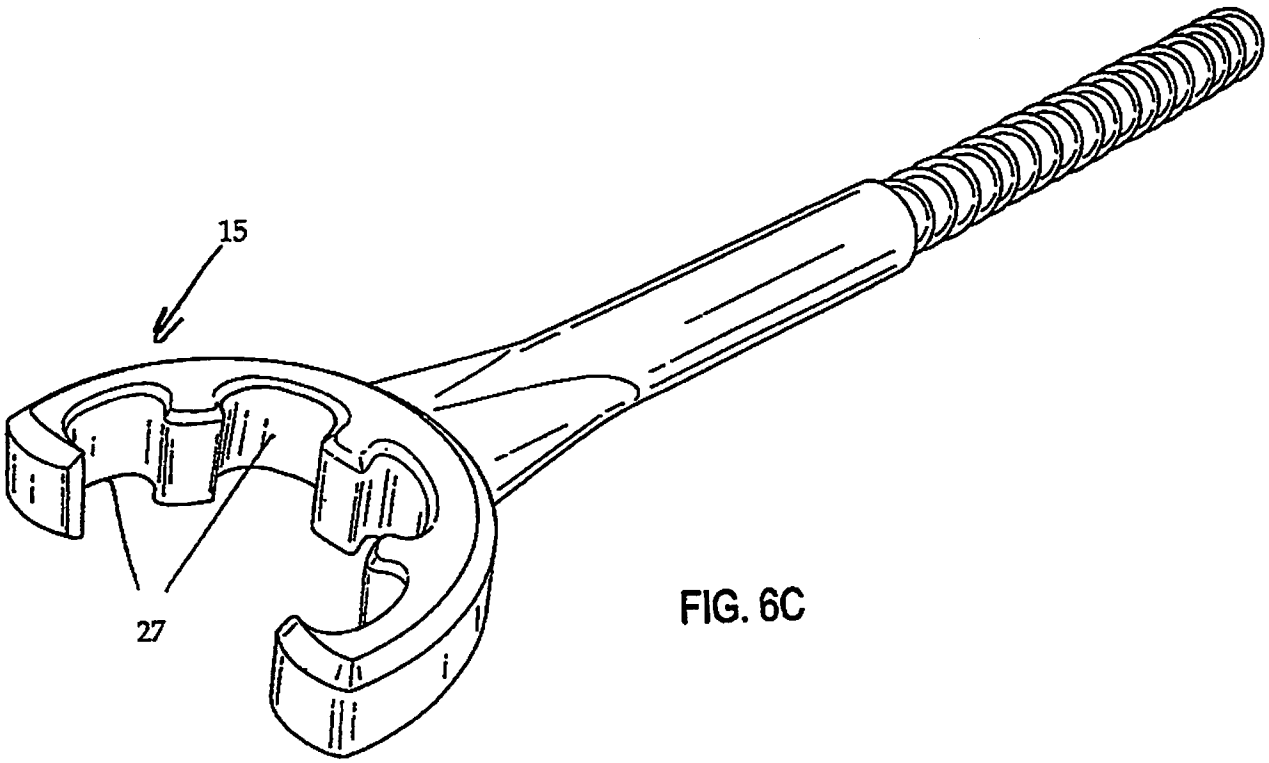

The FIG. 1 embodiment illustrates five indentations 27 in tool head 15, but other embodiments could have more or fewer than five indentations; e.g., one, two, three, four, six, or more indentations (see FIG. 4A showing two indentations, FIG. 6C showing four indentations, or FIG. 5C showing six indentations). FIG. 1 further shows the base section 16 of tool head 15 having two slogging plates 11 attached thereto. In many embodiments, but not necessarily all, the indentations will be spaced (indentation center point 29 to indentation center point 29 in FIG. 3) at about 60° arcs or about 120° arcs. For example, FIG. 3 illustrates adjacent indentation center points 29 spaced 60° apart, while FIG. 4A is an example of indentation center points being 120° apart. In many embodiments, the center of the open throat 30 will have a similar spacing from adjacent indentations 27, i.e., a 60° arc in the case of five indentations or a 120° arc in case of two indentations.

Figure 2:
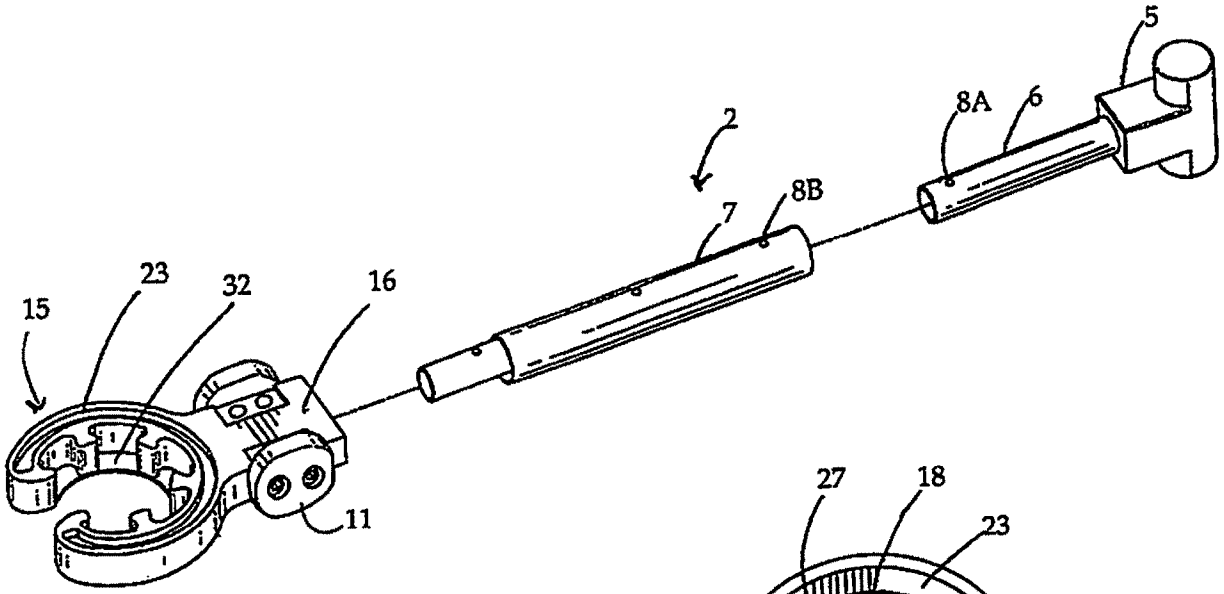
FIG. 2 is an perspective exploded view of a second embodiment of the hammer union tool.

Other embodiments such as suggested in FIG. 2 may include additional features. The FIG. 2 embodiment illustrates stop surfaces 32 extending at least partially over one face of the indentations 27. In this embodiment, the stop surfaces 32 are thin sections of metal covering the lower face ("lower" in the position shown in FIG. 2) of the tool head 15. It may be envisioned how stop surfaces 32 allow the user to position the open or "top" side of the indentations 27 over a hammer union, but will prevent the hammer union from passing through the bottom side of the indentations. Thus, stop surfaces 32 assist in rapid and secure positioning of the tool 1 on the hammer union.

FIG. 2 also illustrates how this embodiment will include an adjustable, telescoping handle section 2. Telescoping insert 6 will side into handle extension 7 and be fixed into position by a pin engaging pin apertures 8A and 8B. Handle extension 7 may be secured to tool head base section 16 by a similar pinning method. In the FIG. 2 embodiment, the end of telescoping insert 6 includes the hammer section 5, which can be used in conjunction with slogging plates 11. Slogging plates 11 provide a striking surface if the hammer section 5 or a similar tool is used to moderately tap the hammer union tool in order to transmit a modest shock load to the hammer union joint.

The tool head can be virtually any size, but in many embodiments, the tool head is designed (sized) to engage a standard hammer union typically designated as 1", 2", 3", 4", 5", or 6". In these examples, the radius from a center of the tool head to the rear wall 28 of the indentations 27, depending on tool size, is between about 2 and 10 inches. FIG. 3 illustrates the tool head engaging the conventional hammer union 95, which has three upsets 96 (the upsets also sometimes referred to as "pegs," "dogs," or other similar terms). FIG. 3 suggests how the enlarged indentations 27 would be capable of fitting around the upsets 96 even in instances where the upsets have been significantly deformed through previous heavy use (e.g., where the upsets have been struck repeatedly with heavy hammers). In particular, FIG. 3 suggests how teeth 18 will tend to engage hammer union 95 at each shoulder portion 97 associated with an upset 96, thereby applying a uniform torque load on each upset of the hammer union 95.

Figure 4B:
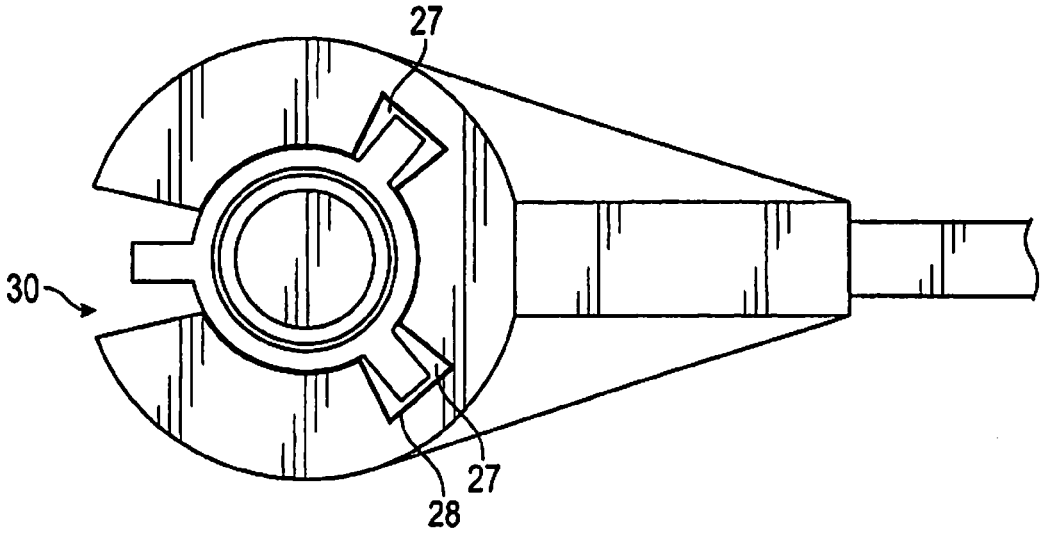
FIG. 4B is a top planar view of a fourth hammer union tool embodiment.

As suggested above, FIG. 4A illustrates an embodiment of tool head 15 having only two indentations 27 for engaging the hammer union upsets 96. In FIG. 4A, the indentations have the curved rearward wall 28 described in reference to FIG. 1. Alternatively, the embodiment of FIG. 4B illustrates an embodiment of tool head 15 where the indentations 27 have straight rear walls 28. However, the indentations 27 become progressively wider as they extend in the direction running from the center of the tool head toward the outer circumference of the tool head. Thus, as with previously described indentations 27, those of FIG. 4B are narrow at the mouth of the indentation and wider at the mid-section width of the indentation. In FIG. 4B, the indentations have the greatest width at the rear wall 28.

FIGS. 5A to 5C illustrate another embodiment of the invention. This embodiment includes a hammer union tool with a ratcheting mechanism. The tool head 15 comprises two hinged sections (or partial ring segments) 35A and 35B, which are joined at hinge 40 and can transition between an open ring configuration and a closed ring configuration where locking latch 41 secures together the sections 35A and 35B. In FIGS. 5A and 5B, locking latch 41 is a simple pin on section 35A engaging a pin aperture on section 35B. Positioned within the hinged sections 35A and 35B are two partial ring shaped insert pieces 36A and 36B seen in FIG. 5B. Both insert pieces 36A and 36B will include a series of ratchet notches 38 positioned around their outer perimeter. Indentations 37 for engaging hammer union upsets will be formed on the inner perimeter of insert pieces 36A and 36B. The ratchet notches 38 interact with the ratchet tongue 39 positioned within hinged section 35A. Although not explicitly shown, a spring or other biasing means will bias ratchet tongue 39 outward (as shown in FIG. 5B), but allows ratchet tongue 39 to deflect into the body of hinged section 35A. It may be envisioned how ratchet tongue 39 will deflect inward when the insert pieces rotate clockwise (i.e., letting the ratchet notches 38 pass). However, when the insert pieces rotate counter-clockwise, the ratchet tongue 39 will engage a ratchet notch 38 and prevent rotation of the insert pieces 36, thereby allowing the wrench to apply torque in that angular direction.

It can be seen that the insert pieces 36A and 36B in FIG. 5B have generally square indentations 37. One alternative design is seen in the insert pieces 36A and 36B illustrated in FIG. 5C. These FIG. 5C insert pieces 36A and 36B have curved indentations 37 with the characteristics described in reference to FIG. 1 above. Although the embodiments in FIGS. 5A to 5C illustrate six indentations in the tool head, other embodiments could certainly encompass fewer than six indentations (e.g. three indentations) or in specialized embodiments, potentially more than six indentations.

FIGS. 6A to 6C illustrate a still further embodiment. In FIGS. 6A to 6C, the tool head 15 generally comprises an arc of only about 180° and provides a much more open throat area 30. The illustrated embodiments include four indentations 27 which will engage two upsets 96 on the hammer union 95 as suggested in FIG. 6B. Again, alternative designs could have fewer (or possibly more) indentations 27. While FIG. 6A shows a tool with square indentations 27, FIG. 6C shows the indentations with curved rear walls as seen in FIG. 1.

Figure 7A:
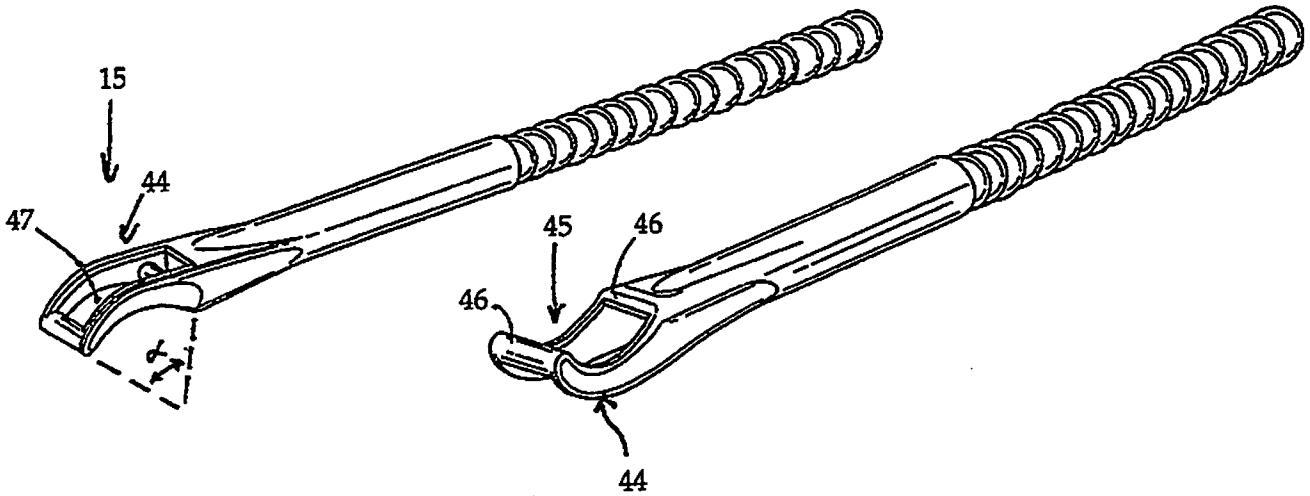
FIGS. 7A to 7E are perspective views of a seventh hammer union tool embodiment.
Figure 7B:
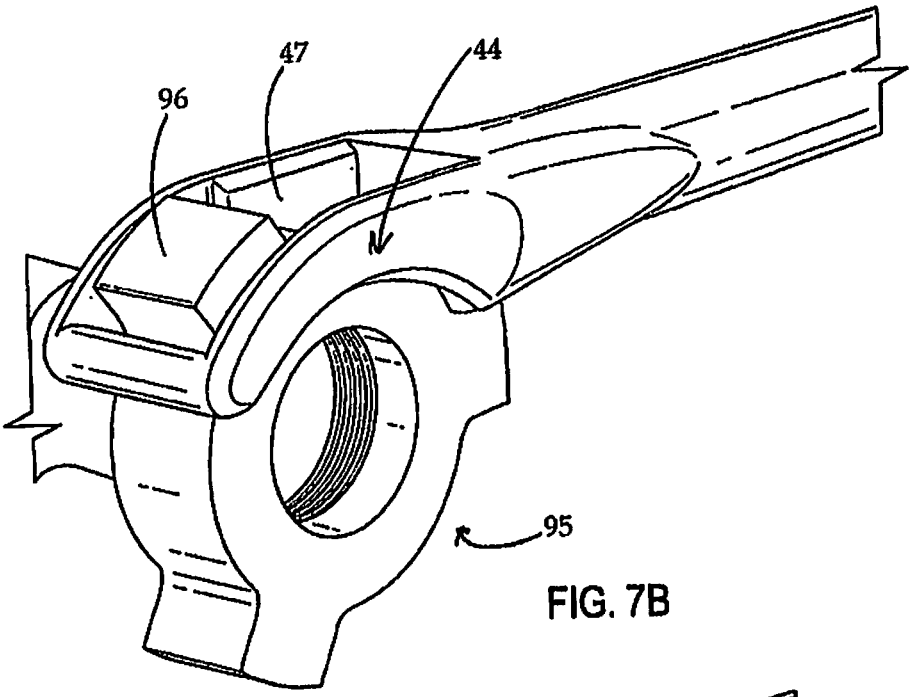
Figure 7C:
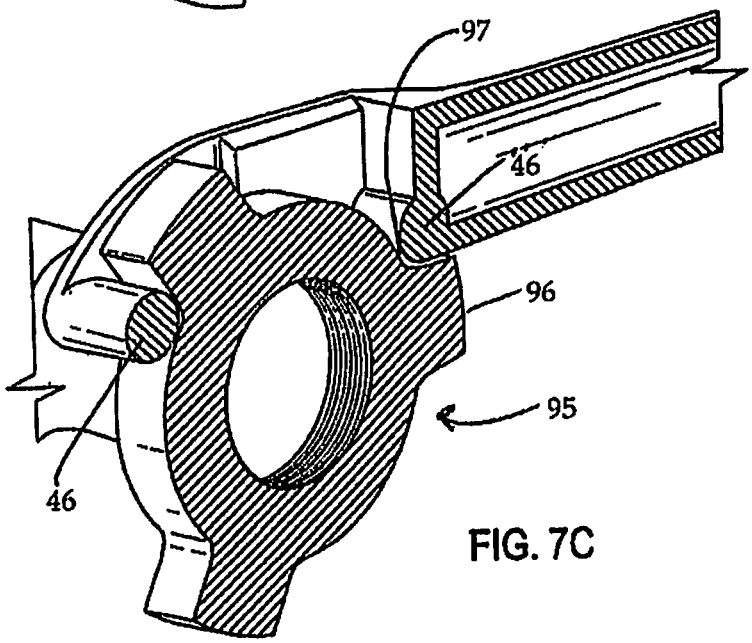
Figures 7D, 7E:
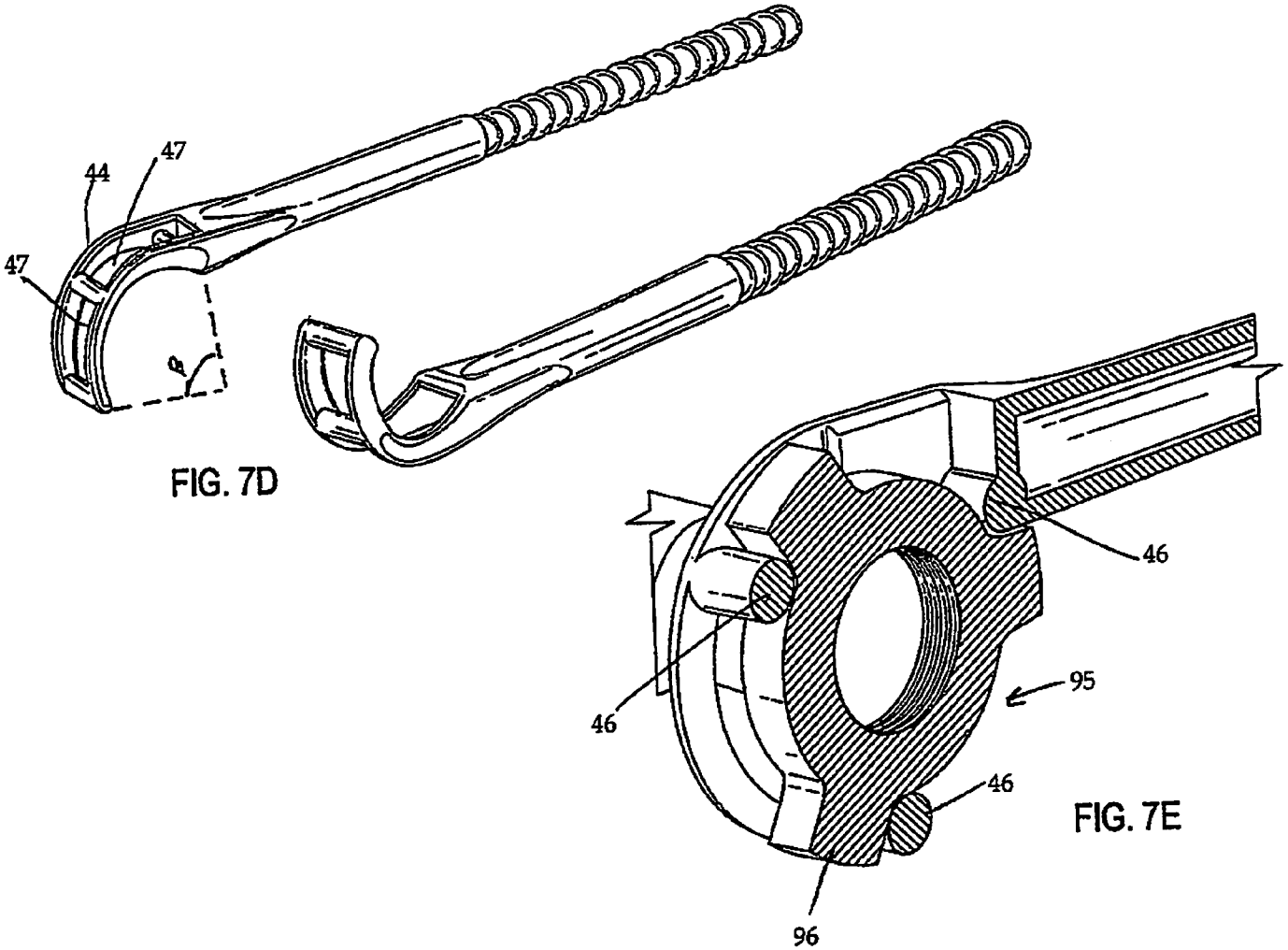

FIGS. 7A to 7D illustrate one further embodiment in which tool head 15 takes on a significantly different configuration from previous embodiments. The tool head 15 is formed of an arcuate body section 44 which leaves an open face section 45. Additionally, an aperture 47 is formed through the rear surface of arcuate body section 44. In the FIG. 7A embodiment, the arcuate body section has an arc length alpha of about 120°. Similarly, the tool head includes two lug members 46 position on each end of the body section, i.e., the lug members 46 are spaced about 120° apart. As will be apparent from FIGS. 7B and 7C, the 120° spacing of lug members 46 allows them to engage the hammer union upsets 96 (or shoulders 97 at the base of upsets 96) of hammer union 95. FIGS. 7B and 7C also illustrate how rear aperture 47 allows the hammer union upset 96 to readily extend at least partially into or through arcuate body section 44 to the extent needed for the tool head to be easily placed on the hammer union 95. FIGS. 7D and 7E suggest how this design may be modified such that arcuate body section 44 has an arc length beta of about 240° and includes two rear apertures 47 and three lug members 46. As is clear from FIG. 7E, this allows the tool head to engage all three upsets 96 on the hammer union 95.

Figure 8:
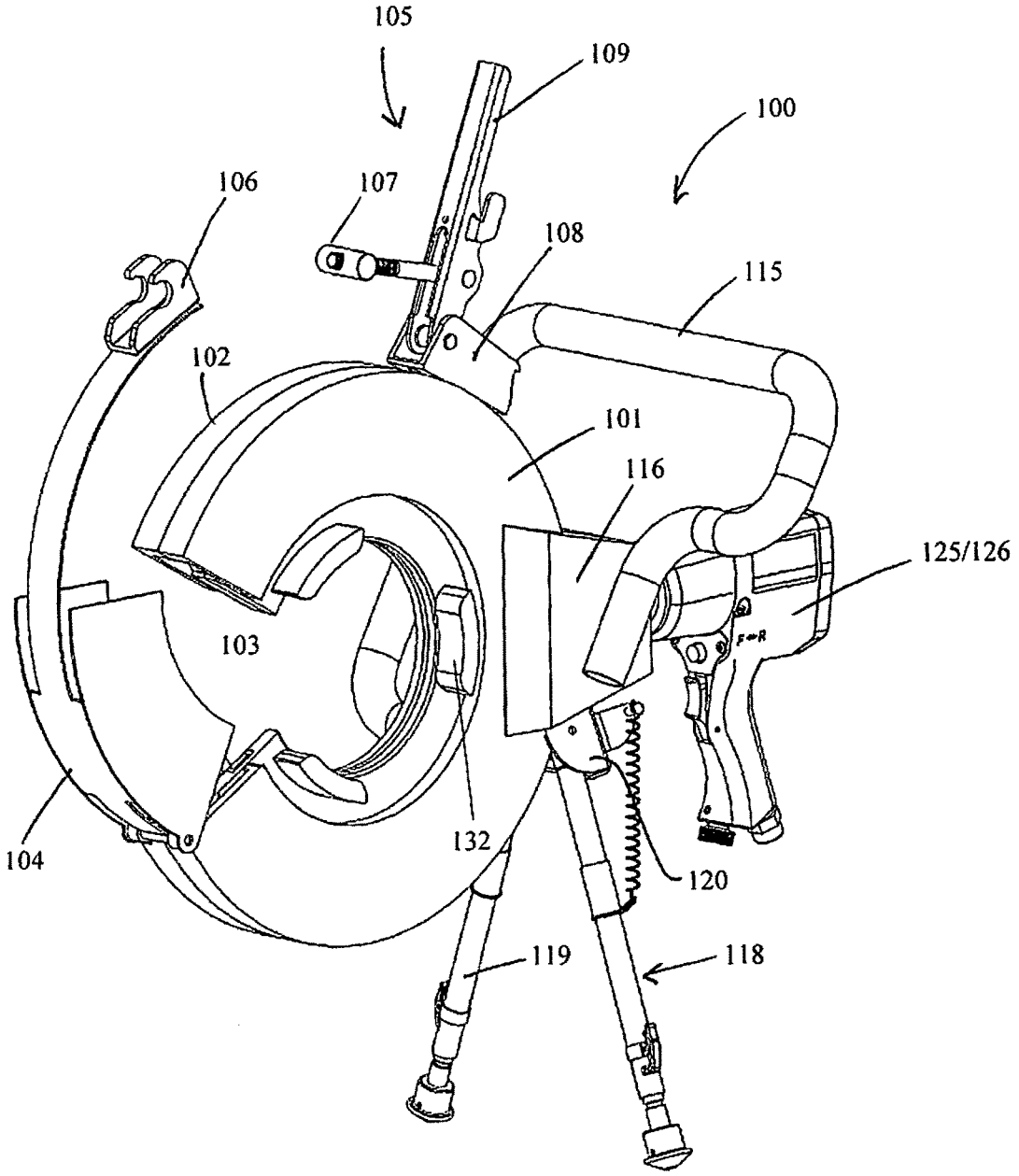
FIG. 8 is a perspective view of a pneumatically powered embodiment of a hammer union tool.

FIG. 8 illustrates an another embodiment of a hammer union tool according to the present invention. FIG. 8 shows a power-driven hammer union tool 100. In the FIG. 8 embodiment, the power (torque) source 125 is an pneumatic impact wrench 126, but in alternate embodiments could be another torque source, for example, hydraulically driven or electrically driven. Power driven tool 100 generally comprises a first (also referred to as "upper" or "left") chassis 101, a second (also referred to as "lower" or "right") chassis 102, gear train cover / housing sections 116, handle 115 connected housing sections 116, gate or door 104, and bipod 118. Bipod 118 includes legs 119 and bipod bracket 120 which connects legs 119 to first and second chassis 101 and 102. It can be seen that gate 104 is hinged to chassis 101/102 on one side and has hook member 106 on the other side. A latch assembly 105 is positioned on chassis 101/102 by way of latch base 108. The lever handle 109 is hinged to latch base 105 and includes the toggle member 107. It can readily be seen that when toggle member 107 engages hook member 106 and lever handle 109 is rotated to its rearward position, then gate 104 will be locked closed across throat 103 of the hammer union tool 100.

Figure 9:
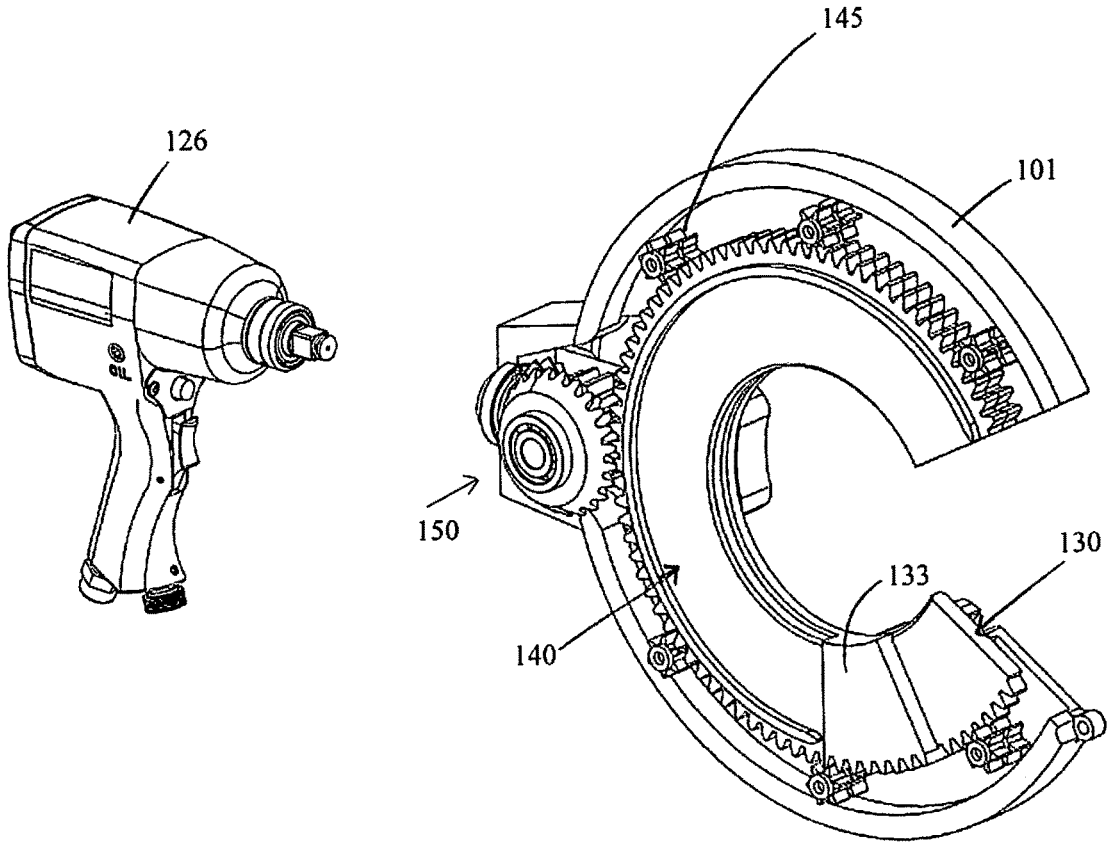
FIG. 9 is a partially exploded view of the FIG. 8 embodiment.
Figure 10A:
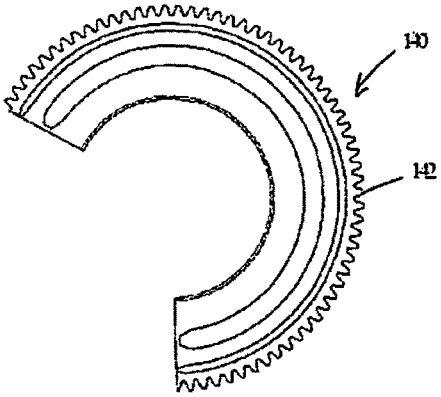
FIGS. 10A to 10D are views of ring gear components of the FIG. 8 embodiment.
Figure 10B:
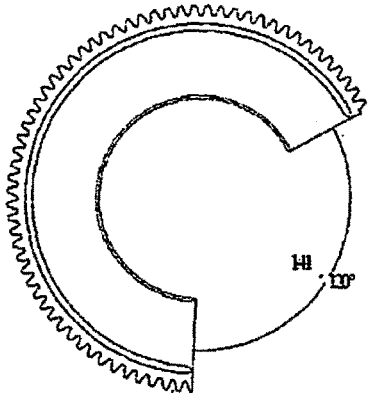
Figure 10C:
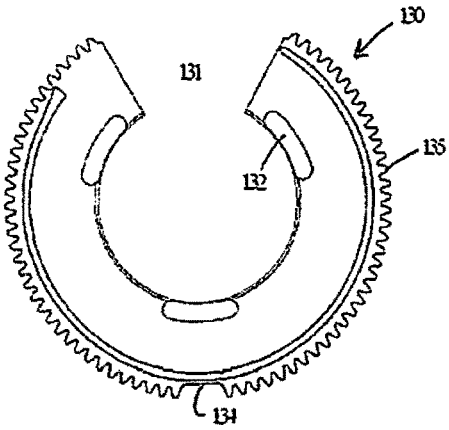
Figure 10D:
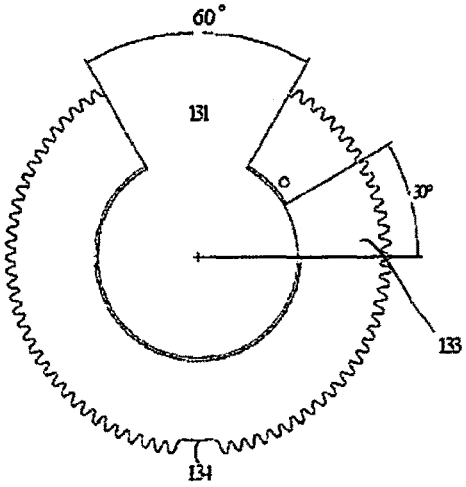
Figure 12:
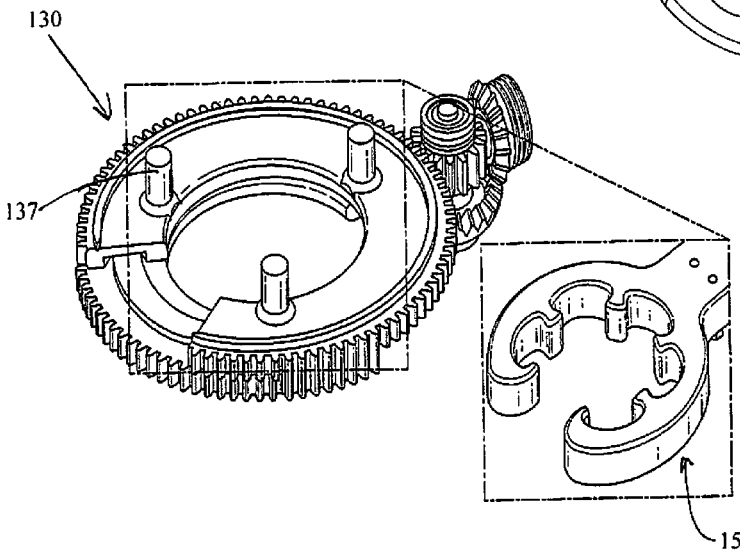
FIG. 12 is a conceptual view of one modification to the FIG. 8 embodiment.

FIG. 9 illustrates the main internal components of hammer union tool 100 by removing the second chassis 102. A gear train 150 (powered by impact wrench 126) drives two ring gear (or sometimes "drive plate") sections: first ("upper" or "left") ring gear 130 and second ("lower" or "right") ring gear 140. A series of idler gears 145 are pinned between chassis 101/102 and maintain the proper alignment of the ring gears 130/140 in the chassis. FIGS. 10A and 10B show opposing surfaces of ring gear 140 in further detail while FIGS. 10C and 10D show ring gear 130. FIGS. 10 A and 10B illustrate the series of gear teeth 142 along the ring gear periphery and an open throat portion 141. Ring gear 130 is similar in having gear teeth 135 and open throat 131, but the throat 131 has an arc distance of about 60° while the throat 141 of ring gear 140 has an arc distance of about 120°. Naturally, the absolute or relative arc distances of open throat sections 131 and 141 could vary from these values, which are provided merely as examples. FIG. 10D illustrates a raise shoulder portion 133 having an arc length of about 30° (see also FIG. 9) on ring gear 130. FIG. 10C also shows three extensions or arcuate-shaped lugs 132 positioned on the exterior face of ring gear 130 (see also FIG. 8). It can be seen that these lugs 132 are centered at 120° arcs from one another in order to engage the upsets on a hammer union joint. Of course, the extensions from ring gear 130 could take any number of forms. For example, FIG. 12 shows the extensions as a series of pegs 137. Likewise, FIG. 12 suggests how a tool head 15 from the FIG. 1 embodiment could be fixed to ring gear 130 and serve as the extensions used to engage the hammer union upsets. Finally, FIGS. 10C and 10D show how ring gear 130 includes the discontinuity 134 in the gear teeth 135. This discontinuity 134 is positioned opposite of open throat 131 for reasons which will be described below.

Figure 11B:
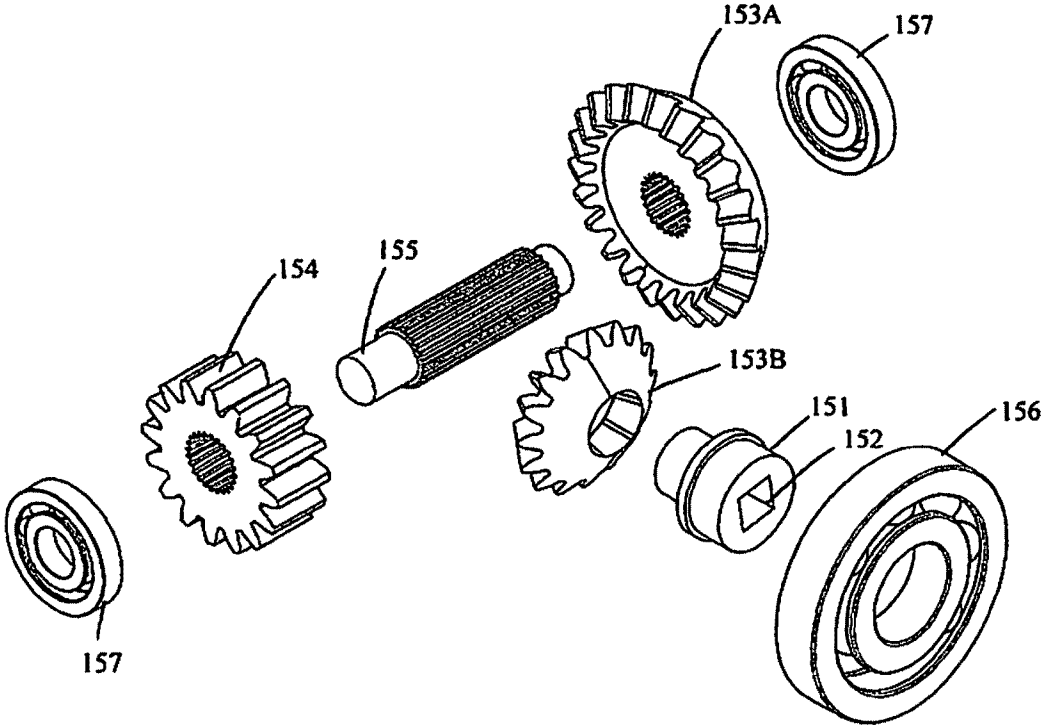
FIGS. 11A and 11B are views of the gear train of the FIG. 8 embodiment.
Figure 11A:
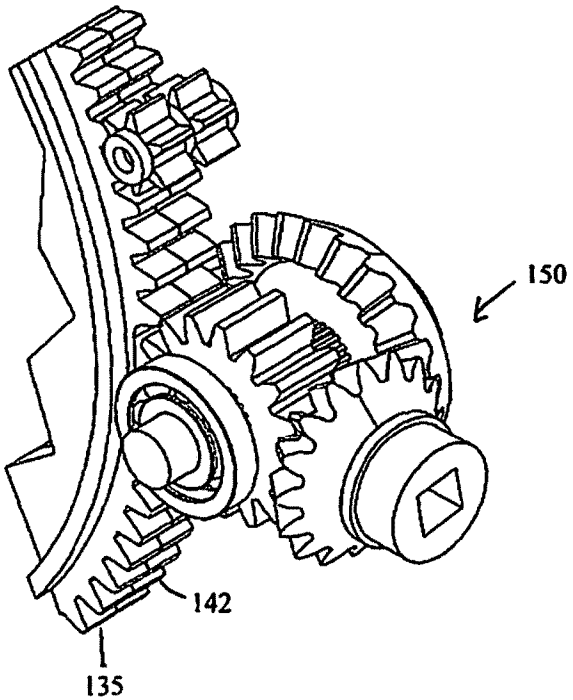

FIG. 11A shows a more detailed view of gear train 150 engaging the gear teeth 135 and 142 on ring gears 130 and 140. The exploded view of FIG. 11B more clearly illustrates the components of gear train 150. The drive shaft 151 (with impact wrench connector 152) will be rotatively mounted in the gear covers 116 (see FIG. 8) by way of the bearing 156. Drive shaft 151 will engage and provide torque to bevel gear 153B which in turn transfers torque to bevel gear 153A. Both bevel gear 153A and spur gear 154 are mounted on splined shaft 155, which in turn engages bearings 157 fixed in gear covers 116. It can be seen how bevel gear 153A transfers torque, through splined shaft 155, to spur gear 154 which ultimately engages ring gears 130 and 140.

The operation of powered hammer union tool 100 can be understood with reference to FIGS. 9 and 10A to 10D. The pipe section to which a hammer union is connected is passed through the open throat of tool 100 when the tool is in the position seen in FIG. 9. When (clockwise) torque is applied to the ring gears via gear train 150, ring gear 140 begins rotating clockwise. In the position seen in FIG. 9, ring gear 130 does not initially rotate because the gear teeth discontinuity section 134 (see FIG. 10C) is positioned at the location of spur gear 154. As ring gear 140 continues to rotate, its leading edge will eventually engage raised shoulder section 133 on ring gear 130. Ring gear 140 will then begin rotating ring gear 130. As the discontinuity section 134 moves beyond spur gear 154, the spur gear will begin applying torque to both ring gears. The operator then positions the tool 100 so the lugs 132 engage the upsets of the hammer union and torque may be applied from the tool to the hammer union. To return the tool to the open throat position, the operator reverses the torque direction on impact wrench 126. When discontinuity section 133 reaches spur gear 154, ring gear 130 will cease rotation with its open throat aligned with the throat of chassis 101/102. The operator then manually ceases torque input from impact wrench 126 as the open throat of ring gear 140 also becomes aligned with the throat of the chassis.

Figure 13A:
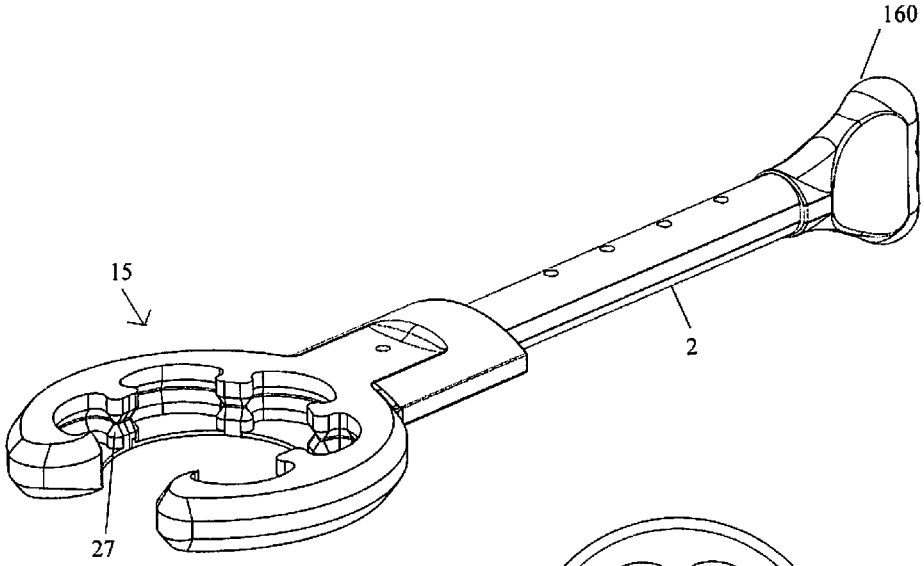
FIGS. 13A and 13B are views of a ninth hammer union tool embodiment.
Figure 13B:
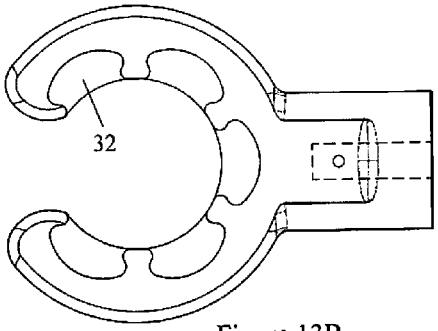

FIGS. 13A and 13B illustrate one further embodiment of hammer union tool 1. This embodiment of tool 1 shows the handle 2 which terminates with the hand loop 160. The hand loop 160 will be sized such that the operator may insert his or her fingers though the hand loop when using tool 1. The hand loop is oriented in a plane that is perpendicular to the plane in which tool head 15 is oriented. Additionally, the tool head 15 has beveled outer edges and beveled inner surfaces along indentions 27. As suggested in FIG. 13B, this embodiment also includes the stop surfaces 32 as described above in reference to FIG. 2.

The further exemplary embodiments defined below illustrate different aspects of the invention. Embodiment A is tool for applying torque to a hammer union, the tool comprising: (a) at least one ring gear having at least one face which includes multiple extensions spaced to simultaneously engage the upsets of a hammer union; (b) a torque source; and (c) a gear train for transferring torques from the torque source to the ring gear.

Embodiment A includes variations such as: (1) further comprising first and second ring gears each of which (i) have gear teeth along their periphery and (ii) may move relative to one another; (2) wherein the ring gear has an open throat; (3) wherein the two ring gears have an open throats which may align in one position and form a closed ring configuration in another position; (4) wherein in one of the ring gears has a stop shoulder against which an end of the other ring gear rests when the ring gear is in the closed ring configuration; (5) wherein the open throat of the first ring gear has an open throat smaller in arc length than the open throat of the second ring gear; (6) wherein the first ring gear includes the extensions and has a discontinuity of the gear teeth positioned opposite the open throat: (7) wherein the face has at least three extensions; (8) wherein the extensions are round pegs: (9) wherein the extensions are arcuate lugs; (10) further comprising a tool body housing the ring gears and gear train; (11) further comprising a gate connected to the housing for selectively closing the open throat of the ring gears: (12) wherein one face of the tool head further comprises stop surfaces extending at least partially over at least one indentation; (13) wherein stop surfaces extend at least partially over all the indentations; (14) wherein the tool head has an open throat section: (15) wherein single face, tapered teeth flank the open throat section: (15) wherein the handle comprises at least two telescoping sections; (16) wherein a radius from a center of the tool head to the rearward wall of the indentations is between about 2 and about 10 inches; (17) wherein the indentations have a rear wall with a radius of curvature between about 0.5 inches and about 2.5 inches; (18) wherein the tool head further comprises a pair of slogging plates positioned rearward on the tool head: (19) wherein one telescoping section of the handle includes a weighted hammer head with a striking surface; (20) wherein a center of the open throat section and a center of the indentations are space at about 120° arcs from one another; and (21) wherein a center of the open throat section and a center of the indentations are space at about 60° arcs from one another.

Embodiment B is a tool for applying torque to a hammer union, the tool comprising a handle attached to a tool head, the tool head including: (a) at least three teeth, at least one of the teeth having a mid-portion and an enlarged end portion wider than the mid-portion; and (b) enlarged indentations between the teeth, the indentations having a mouth width and a mid-section width, wherein the mid-section width is greater than the mouth width.

Embodiment B includes variations such as (1) further comprising at least three indentations spaced to accommodate three upsets of a hammer union joint: (2) wherein a center of the three indentations are spaced at about 120° arcs from one another; (3) wherein the teeth are formed at opposing edges of the indentations; and (4) wherein one telescoping section of the handle includes a weighted hammer head with a striking surface.

Embodiment C is a tool for applying torque to a hammer union, the tool comprising a handle attached to a tool head, the tool head including: (a) at least three teeth, the teeth having a mid-portion and an enlarged end portion wider than the mid-portion; (b) enlarged indentations between the teeth, the indentations providing clearance to upsets of the hammer union such that the teeth engage a shoulder portion of the upsets.

Embodiment C includes variations such as (1) wherein the indentations form a clover-leaf pattern within the tool head; (2) wherein a tooth between two adjacent indentations is a dual face tooth including a mid-portion and an enlarged end portion wider than the mid-portion: (3) wherein stop surfaces extend at least partially over all the indentations; and (4) wherein the tool head has an open throat section.

Embodiment D is a tool for applying torque to a hammer union having three upsets, the tool comprising a handle attached to a tool head, the tool head including: (a) a head frame having at least two partial ring segments being hinged to move between an open ring positioned and a closed ring position; and (b) at least three indentations for engaging the union upsets formed on the two partial ring segments.

Embodiment D includes variations such as (1) wherein the indentations are formed on insert pieces which fit within the partial ring segments; (2) wherein a ratchet mechanism is positioned between the insert pieces and at least one of the ring segments, thereby allowing the insert pieces to rotate in only one direction; (3) wherein the ratchet mechanism includes a series of ratchet notches formed in an outer perimeter of the insert pieces and a ratchet tongue formed in at least one of the partial ring segments; (4) wherein each insert piece has at least one indentation formed therein; (5) wherein a locking mechanism retains the partial ring segments in the closed ring position; (6) wherein each insert piece has three indentations formed therein; (7) wherein the indentations are predominantly square shaped; (8) wherein the indentations have a predominantly curved rear wall; and (9) wherein the ratchet tongue is biased in an outward direction.

Embodiment E is a tool for applying torque to a hammer union having three upsets, the tool comprising a handle attached to a tool head, the tool head including at least two indentations, the indentations having a rearward wall, a mouth with a first width, and a mid-section with a second width, wherein the mid-section width is greater than the mouth width.

Embodiment E includes variations such as (1) wherein the indentations include a curved rearward wall; (2) wherein the indentations include a straight rearward wall with a width greater than the mid-section width; (3) further comprising an open throat section and a center of the open throat section and a center of the indentations are space at about 120° arcs from one another; (4) wherein the tool head comprises an about 180° arc; and (5) wherein the tool head comprises four indentations and a center of the indentations are space at about 60° arcs from one another.

Embodiment F is a tool for applying torque to a hammer union having three upsets, the tool comprising a handle attached to a tool head, the tool head including (i) an arcuate body section and an open face section, the arcuate body section having an arc length of less than 240°; and (ii) two lug members spaced about 120° to engage two of three hammer union upsets.

Embodiment F includes variations such as (1) wherein the arcuate body section has a rear surface aperture sized to allow a hammer union upset to pass at least partially through the body section; (2) wherein the aperture is sized to allow the hammer union upset to pass completely thought the body section; (3) wherein the lugs are space at about 120° arcs from one another; and (4) wherein the handle terminates in a hand loop which is positioned in a first plane and the first plane is oriented perpendicular to a second plane in which tool head is located.

The terms used in the specification will generally have the meaning ascribed to them by persons skilled in the art, unless otherwise stated. The term "about" will typically mean a numerical value which is approximate and whose small variation would not significantly affect the practice of the disclosed embodiments. Where a numerical limitation is used, unless indicated otherwise by the context, "about" means the numerical value can vary by ±10%, or in certain embodiments ±5%, or even possibly as much as ±20%. Although the foregoing invention has been described in terms of specific embodiments, those skilled in the art will recognize many obvious modifications and variations. All such modifications and variations are intended to fall within the scope of the following claims.

The invention claimed is:

1. A tool for applying torque to a hammer union having three upsets, the tool comprising a handle attached to a tool head, the tool head including:

a. a head frame having at least two partial ring segments being hinged to move between an open ring positioned and a closed ring position;

b. at least three indentations for engaging the union upsets formed on the two partial ring segments, the indentations being formed on insert pieces which fit within the partial ring segments; and c. a ratchet mechanism positioned between the insert pieces and at least one of the ring segments, thereby allowing the insert pieces to rotate in only one direction.

2. The tool according to claim 1, wherein the ratchet mechanism includes a series of ratchet notches formed in an outer perimeter of the insert pieces and a ratchet tongue formed in at least one of the partial ring segments.

3. The tool according to claim 2, wherein the ratchet tongue is biased in an outward direction.

4. The tool according to claim 1, wherein each insert piece has at least one indentation formed therein.

5. The tool according to claim 4, wherein each insert piece has three indentations formed therein.

6. The tool according to claim 1, wherein a locking mechanism retains the partial ring segments in the closed ring position.

7. The tool according to claim 1, wherein the indentations are predominantly square shaped.

8. The tool according to claim 1, wherein the indentations have a predominantly curved rear wall.

* * * * *